US007501748B2

(12) United States Patent
Kim et al.

(10) Patent No.: US 7,501,748 B2
(45) Date of Patent: Mar. 10, 2009

(54) CRT FUNNEL SECTION

(75) Inventors: Mun-Seong Kim, Suwon-si (KR); Hoo-Deuk Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 302 days.

(21) Appl. No.: 11/243,179

(22) Filed: Oct. 5, 2005

(65) Prior Publication Data

US 2006/0087216 A1 Apr. 27, 2006

(30) Foreign Application Priority Data

Oct. 6, 2004 (KR) ..... 10-2004-0079512

(51) Int. Cl.
*H01J 29/86* (2006.01)

(52) U.S. Cl. ..... 313/477 R; 313/440

(58) Field of Classification Search ..... 313/447 R, 313/440; 220/2.1 R, 2.1 A
See application file for complete search history.

(56) References Cited

U.S. PATENT DOCUMENTS 5,763,995 A * 6/1998 Sano et al. ..... 313/477 R
5,801,481 A * 9/1998 Yokota ..... 313/440
6,002,203 A * 12/1999 Yokota et al. ..... 313/477 R
6,255,766 B1 * 7/2001 Park et al. ..... 313/408
6,940,215 B2 * 9/2005 Park ..... 313/477 R
2004/0066131 A1 * 4/2004 Park ..... 313/440

* cited by examiner

*Primary Examiner*—Peter Macchiarolo
(74) *Attorney, Agent, or Firm*—Robert E. Bushnell, Esq.

(57) ABSTRACT

A Cathode Ray Tube (CRT) includes a panel having long and short axes and a tube axis perpendicular to the long and short axes, the panel including an inner phosphor screen. A funnel is attached to the panel, the funnel including a cone having a deflection unit arranged on an outer circumference thereof. A neck is attached to the funnel and has an electron gun arranged therein. The cone has a cross-section taken perpendicular to the tube axis with a shape varied from a circle to a non-circle having a maximum diameter in the directions except for the directions of the long and the short axes of the panel while proceeding from the neck to the panel, and with the cross-section of the cone on the tube axis by a point thereof, the inner and the outer surfaces of the cone in the directions of the long and the short axes are convex toward the tube axis.

6 Claims, 7 Drawing Sheets

CRT FUNNEL SECTION

CLAIM OF PRIORITY

This application makes reference to, incorporates the same herein, and claims all benefits accruing under 35 U.S.C. §119 from an application for CATHODE RAY TUBE earlier filled in the Korean Intellectual Property Office on 6 Oct. 2004 and there duly assigned Ser. No. 10-2004-0079512.

BACKGROUND OF THE INVENTION

1. Field of the Invention

The present invention relates to a Cathode Ray Tube (CRT), and in particular, to a shape of a cone for a CRT having a deflection unit.

2. Description of Related Art

A CRT is an electronic tube which deflects electron beams emitted from an electron gun to a phosphor screen in the horizontal and vertical directions, and lands those electron beams on that screen, thereby striking the phosphors and displaying the desired images. The deflection of the electron beams is effected by a deflection unit, which is mounted around the outer circumference of a funnel (practically, the outer circumference of a cone forming the vacuum tube), and generates horizontal and vertical magnetic fields.

The CRT has been mainly used in color televisions and computer monitors, and have recently been used for a high-grade product, such as an HDTV.

In order to improve the definition of the CRT, that is, in order use the CRT for HDTV or other OA equipment, or to enhance the brightness of the CRT, the deflection frequency of the deflection yoke must be increased, which results in the deflection power being elevated so that the leakage of magnetic fields and the power consumption are increased.

Such a problem made due to the elevation of the deflection power is a critical factor in improving the definition of the CRT.

In this connection, a technique of enhancing the deflection efficiency of the deflection yoke for the electron beams by reducing the diameter of a neck of the vacuum tube and the neck-sided outer diameter of the funnel is conventionally used in manufacturing the CRT. However, with the technique, a so-called Beam Strike Neck (BSN) phenomenon occurs where the electron beams to be directed toward the corners of the screen collide against the neck-sided inner wall of the funnel, and the desired image is not obtained.

As the trajectories of the electron beams have not conventionally measured in a suitable manner, the manufacturing of the CRT depends largely upon the occasional experiences of the manufacturer or through trial and error. In this situation, it becomes difficult to effectively solve the BSN problem of the electron beams.

The technique of lowering the deflection power simply to maximize the deflection efficiency by reducing the neck-sided outer diameter of the funnel is limited due to the BSN problem of the electron beams.

Accordingly, efforts have been made to appropriately form the cone of the funnel mounted with the deflection unit in CRTs (such that the section thereof vertical to the tube axis is rectangular-shaped), and solve the BSN problem of the electron beams while lowering the deflection power.

That is, the shape of the cone is improved such that the deflection unit for forming a deflection magnetic field comes closer to the scanning trajectories of the electron beams, thereby reducing the deflecting sensitivity and lowering the power consumption.

With the CRT having a rectangular-shaped cone, the inner and outer surfaces of the cone are convex to the outside of the tube axis of the CRT. When a deflection unit is mounted around the rectangular-shaped cone, the shape of the cone becomes to be a factor of preventing the electron beams from coming closer to the scanning trajectories of the electron beams. This is because the cone is simply formed with a rectangular section without considering the BSN margin of the electron beams in the horizontal, the vertical and the diagonal directions of the electron beams scanned toward the phosphor screen from the electron gun.

Accordingly, with a CRT having such a rectangular-shaped cone, the shape of the cone causes a problem in minimizing the deflection power.

SUMMARY OF THE INVENTION

It is an object of the present invention to provide a Cathode Ray Tube (CRT) which minimizes the deflection power and lowers the power consumption by improving the shape of a cone mounted with a deflection unit.

The present invention provides a Cathode Ray Tube (CRT) including: a panel having long and short axes and a tube axis perpendicular to the long and short axes, the panel including an inner phosphor screen; a funnel attached to the panel, the funnel including a cone having a deflection unit arranged on an outer circumference thereof; and a neck attached to the funnel and having an electron gun arranged therein; wherein the cone has a cross-section taken perpendicular to the tube axis with a shape varied from a circle to a non-circle having a maximum diameter in the directions except for the directions of the long and the short axes of the panel while proceeding from the neck to the panel, and with the cross-section of the cone on the tube axis by a point thereof, the inner and the outer surfaces of the cone in the directions of the long and the short axes are convex toward the tube axis.

Inner and outer surfaces of the cone are preferably convex at centers thereof toward the tube axis.

A radius of curvature Rh of an arc determining inner and the outer surfaces of the cone in a direction of the long axis of the panel preferably satisfies the inequality: $300\ \text{mm} < Rh < \infty$. Rh preferably increases while proceeding from the panel to the neck.

A radius of curvature Rv of an arc determining inner and the outer surfaces of the cone in a direction of the short axis of the panel preferably satisfies the inequality: $650\ \text{mm} < Rv < \infty$. Rv increases while proceeding from the panel to the neck.

The deflection unit preferably includes: a horizontal deflection coil and a vertical deflection coil; an insulator arranged between the horizontal deflection coil and the vertical deflection coil; and a ferrite core arranged external to the insulator, the ferrite core being attached to the vertical deflection coil; wherein the horizontal deflection coil and the vertical deflection coil have shapes corresponding to an external shape of the cone.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF INVENTION

The present invention will be described more fully hereinafter with reference to the accompanying drawings, in which exemplary embodiments of the present invention are shown.

Figure 1:
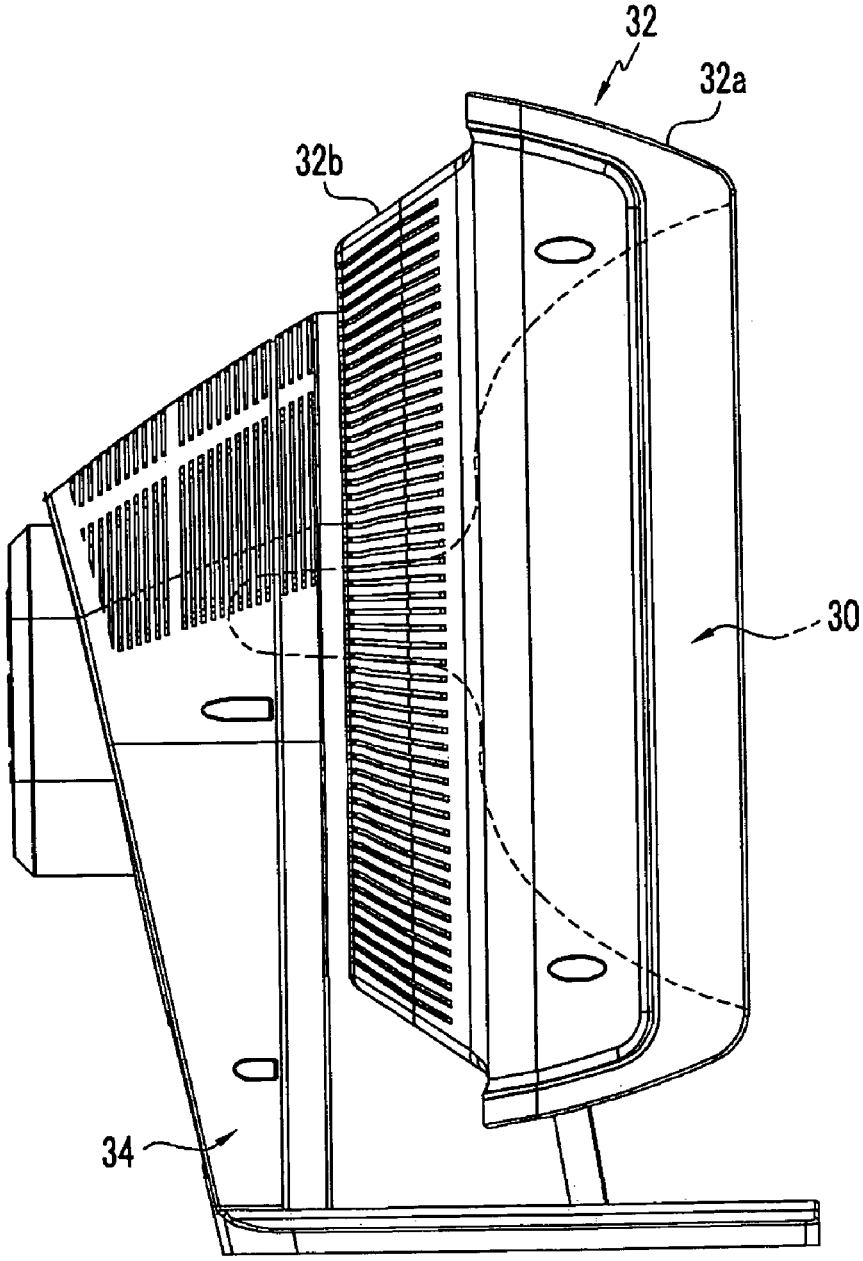
FIG. 1 is a side view of an image display device with a CRT according to an embodiment of the present invention.

FIG. 1 is a side view of an image display device with a CRT according to an embodiment of the present invention.

As shown in the drawing, the image display device includes a CRT 30 for displaying the desired images, a case 32 enclosing the CRT 30 while forming the outer appearance thereof, and a support 34 connected to the case 32 to suspend it.

The case 32 includes a front case portion 32*a* arranged at the front of the CRT 30, and a back case portion 32*b* arranged at the rear of the CRT 30, which are attached to each other by screws, for example. The support 34 is formed as a stand.

The main portion of the CRT 30 is placed within the case 32, and the neck portion thereof within the support 34.

Figure 2:
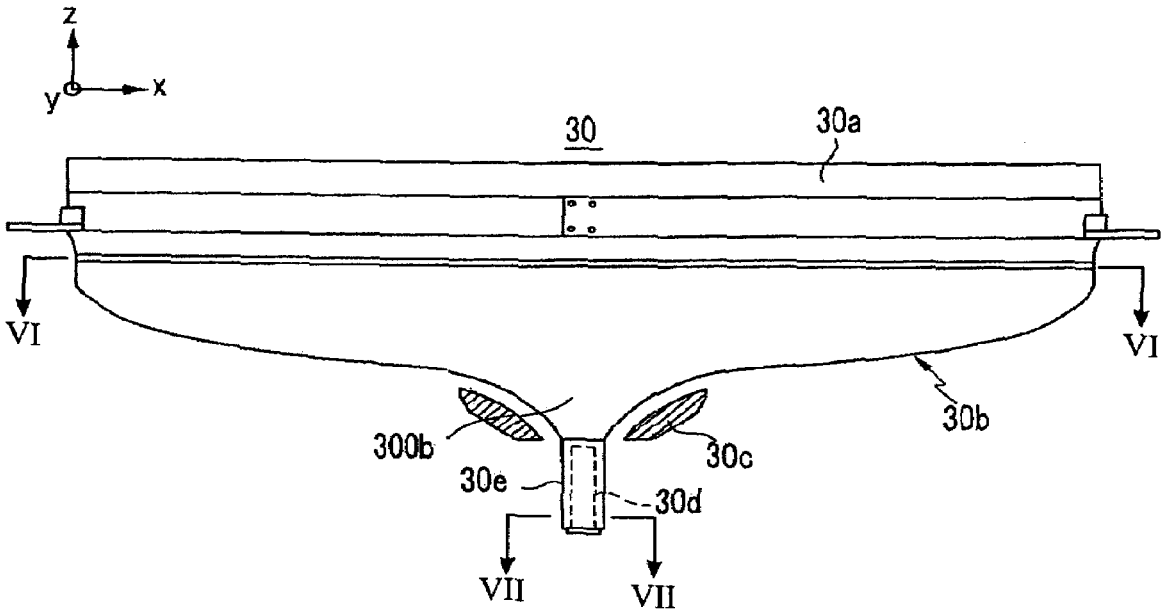
FIG. 2 is a plan view of the CRT according to the embodiment of the present invention.

FIG. 2 is a plan view of the CRT 30. As shown in the drawing, the CRT 30 is a vacuum tube. The tube has a panel 30*a* rectangular-shaped with an inner phosphor screen, a funnel 30*b* connected to the panel 30*a* while mounting a deflection unit 30*c* on the outer circumference of a cone 300*b* thereof, and a neck 30*e* connected to the rear of the cone 300*b* while mounting an electron gun 30*d* therein.

With the above-structured CRT 30, the electron beams emitted from the electron gun 30*d* are deflected by the deflection unit 30*c* to the long axis of the panel 30*a* (the horizontal axis, the x axis of FIG. 2) and to the short axis thereof (the vertical axis, the y axis of FIG. 2). The deflected electron beams pass through electron beam passage holes of a color selection unit internally fitted to the panel 30*a*, and land on the relevant phosphors of the phosphor screen, thereby displaying the desired image.

The CRT 30 conducts the above operation, and reduces the deflecting sensitivity of the deflection unit 30*c* with respect to the electron beams in the way described below to thereby lower the deflection power.

With the CRT 30, the cone 300*b* thereof mounted with the deflection unit 30*c* is shaped such that as it goes from the neck 30*e* to the panel 30*a*, the section thereof (taken perpendicular to the tube axis z of FIG. 2) is gradually varied from a circle to a non-circle with a maximum diameter in the directions except for the directions of the long and short axes x and y of the panel 30*a*, for instance, a rectangle.

Figure 3:
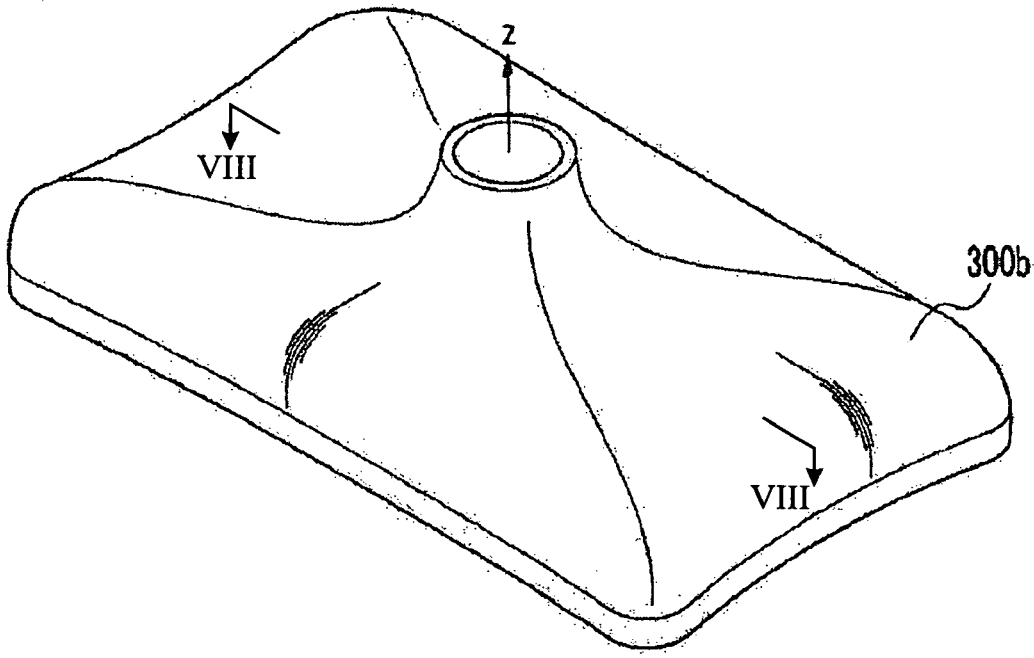
FIG. 3 is a perspective view of a cone of the CRT according to the embodiment of the present invention.
Figure 4:
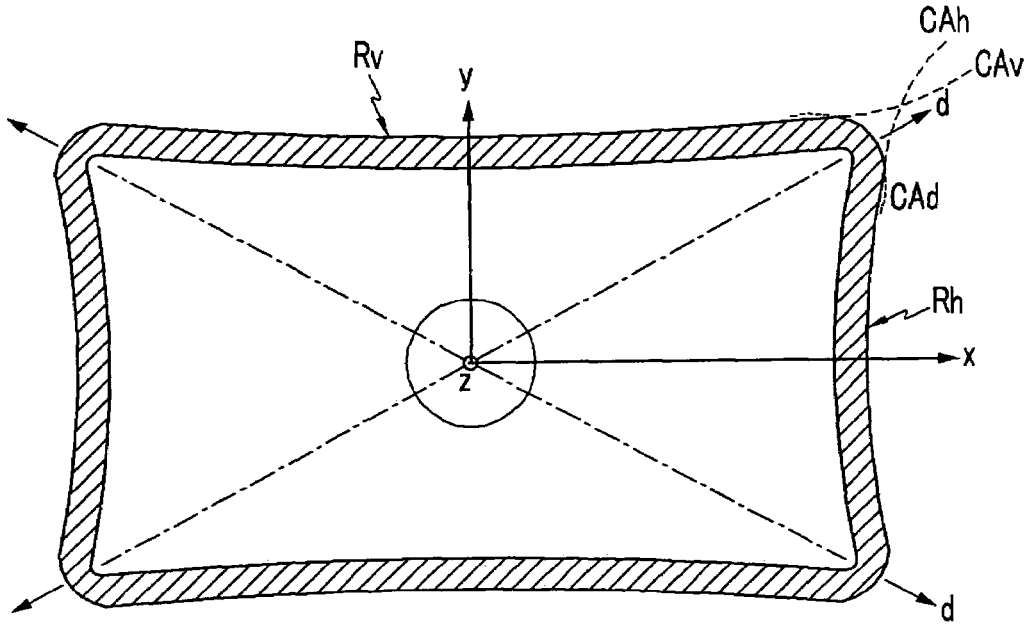
FIG. 4 is a cross-sectional view of the CRT in a plane perpendicular to the tube (z) axis of the CRT of FIG. 3.

FIG. 3 is a perspective view of the cone 300*b*, and FIG. 4 is a cross-sectional view of the cone in a plane perpendicular to the tube (z) axis of the CRT of FIG. 3.

As shown in the drawings, the cone 300*b* gradually varies its shape from a circle to a rectangle as it goes from the neck 30*e* to the panel 30*a*.

The cone 300*b* is structured such that the inner and outer surfaces thereof directed to the long and short axes of the panel 30*a* are convex toward the tube axis z, that is, a radius of curvature of an arc determining inner and the outer surfaces of the cone 300*b* are outside of the tube.

The structural shape of the cone 300*b* is taken considering the scanning trajectories of the electron beams toward the phosphor screen from the electron gun 30*d* such that the BSN problem of the electron beams does not occur, and the cone 300*b* is located closest to the scanning trajectories of the electron beams. Accordingly, the deflection unit 30*c* mounted around the cone 300*b* is placed closer to the scanning trajectories of the electron beams.

For this purpose, from the sectional point of view, the cone 300*b* is formed with a combination of an arc CAh placed in the direction of the long axis x, and an arc CAv placed in the direction of the short axis y, and an arc CAd placed in the direction of the diagonal axis d between the long and the short axes x and y. The arcs CAh and CAv are convex toward the tube axis z, and the arc CAd is concave toward the tube axis z.

When the curvature radius of the arc CAh directed toward the long axis x is indicated by Rh and the curvature radius of the arc CAv directed toward the short axis y by Rv, the values of Rh and Rv are preferably established to be in the following range: 300 mm<Rh<∞, and 650 mm<Rv<∞.

The values of Rh and Rv a gradually increase while proceeding from the panel 30*a* to the neck 30*e*.

The cone 300*b* is shaped like the above because repeated experiments determined that the BSN margin of the electron beams was further made in the directions of the long and short axes rather than in the direction of the diagonal axis.

The portions of the cone 300*b* in the directions of the long and short axes x and y protrude toward the tube axis z, and the deflection unit 30*c* mounted around the outer circumference thereof is positioned closer to the scanning trajectories of the electrons beams by the degree of protrusion to deflect the electron beams.

The deflection unit 30*c* more effectively effects the deflection of electron beams in the vertical and horizontal directions with the same deflection power as in the conventional case, and the deflecting sensitivity is reduced so that the electron beams can be deflected at wider angle.

Consequently, the CRT 30 involves an advantage of enlarged screen size with a reduced thickness. This becomes to be a critical factor in slimming the CRT 30.

Figure 5:
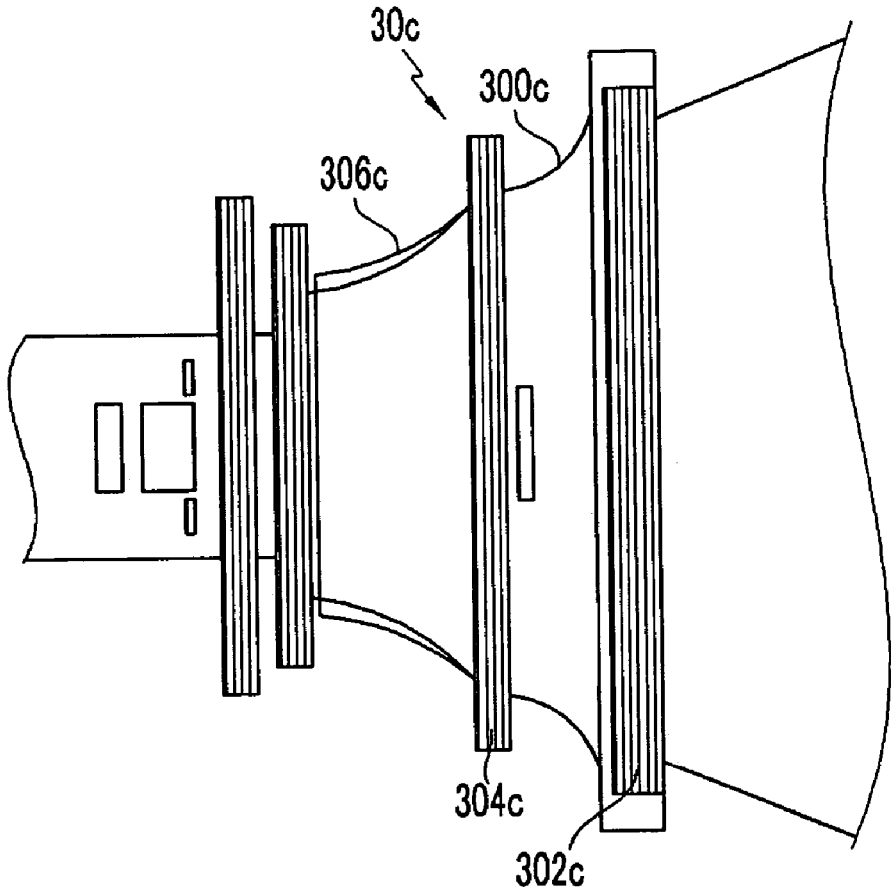
FIG. 5 is a view of a deflection unit mounted around the cone of the CRT according to the embodiment of the present invention.

FIG. 5 schematically illustrates the deflection device 30*c* externally mounted around the cone 300*b*. The deflection device 30*c* includes horizontal and vertical deflection coils 302*c* and 304*c* arranged while interposing an insulator 300*c* with a pair of separators. The horizontal deflection coil 302*c* is placed internal to the insulator 300*c*, and the vertical deflection coil 304*c* is connected to a ferrite core 306*c* while being located external to the insulator 300*c*.

The horizontal and the vertical deflection coils 302*c* and 304*c* are formed in the shape of a saddle, or can be wound on the insulator 300*c*.

As described earlier, the deflection unit 30*c* is preferably formed with a shape corresponding to the shape of the cone 300*b* such that the deflecting sensitivity can be reduced. That is, the insulator 300*c*, the horizontal deflection coil 302*c*, the vertical deflection coil 304*c* and the ferrite core 306*c* are formed corresponding to the shape of the cone 300*b* such that the portions thereof corresponding to the long and the short axes of the panel 30*a* protrude toward the tube axis z.

Figure 6:
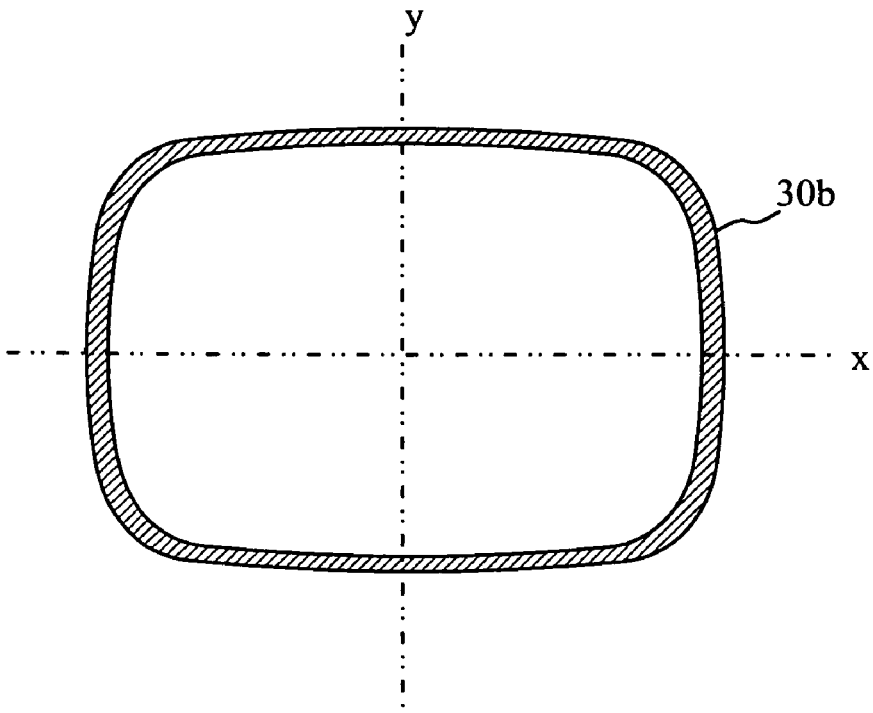
FIG. 6 is a cross-sectional view of the CRT of FIG. 2, taken along line VI-VI.
Figure 7:
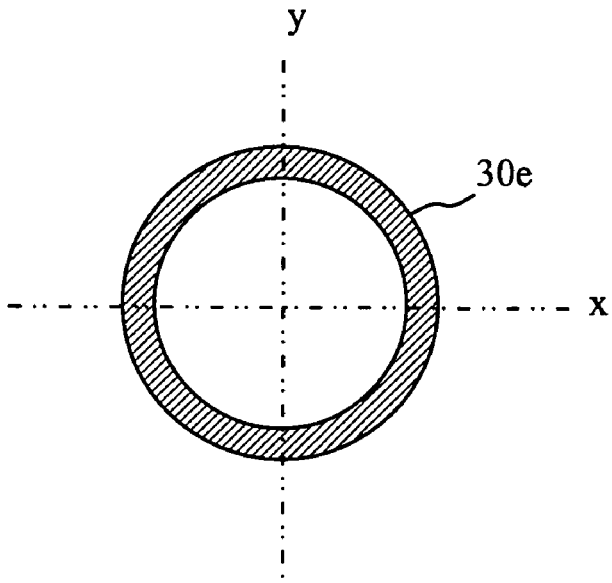
FIG. 7 is a cross-sectional view of the CRT of FIG. 2, taken along line VII-VII.
Figure 8:
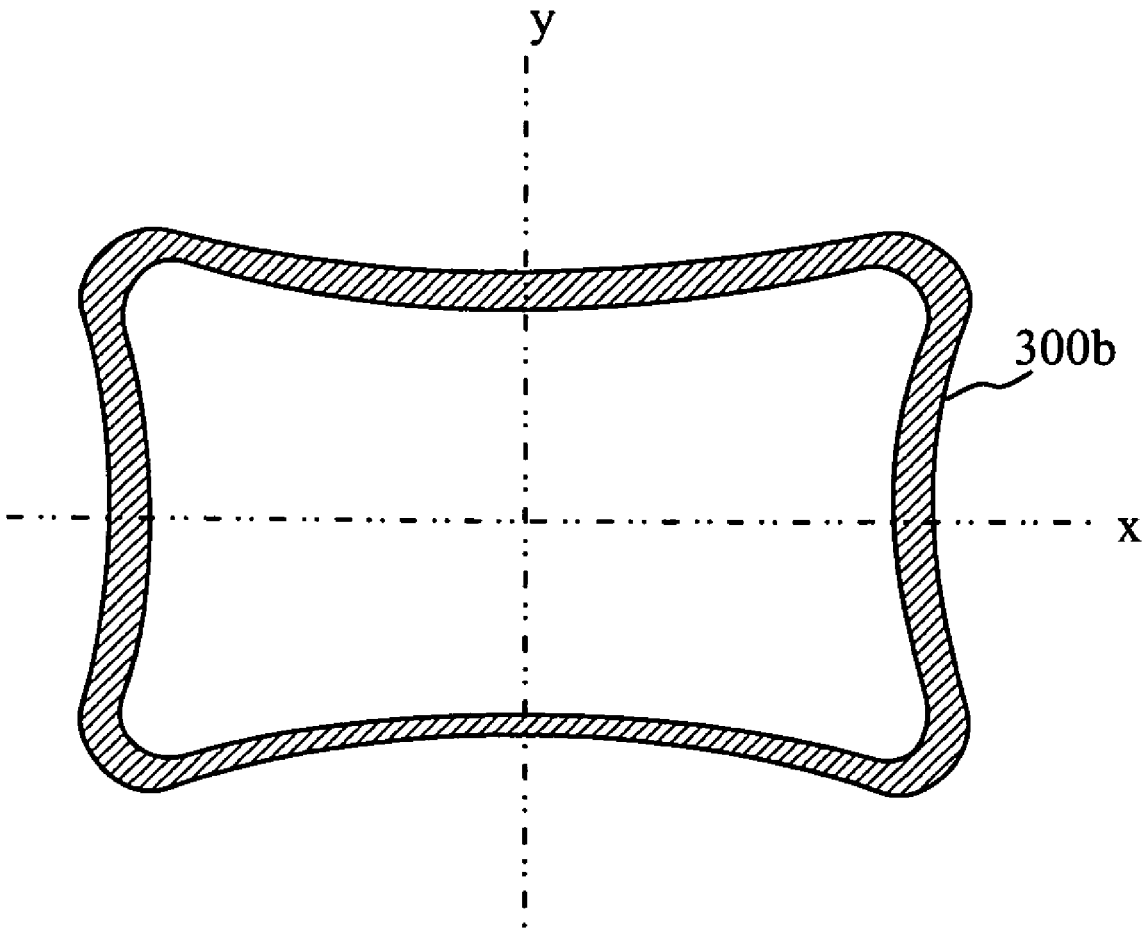
FIG. 8 is a cross-sectional view of the CRT of FIG. 3, taken along line VIII-VIII.

FIGS. 6, 7 and 8 are cross-sectional views of the CRTs of FIGS. 2 and 3 and show features of the CRT according to the above-described embodiment of the present invention.

It is most preferable that all the structural components of the deflection unit 30*c* are convex, but occasionally, only the horizontal and the vertical deflection coils 304*c* forming the deflection magnetic field can be convex.

As described above, with the present invention, the shape of the cone mounting the deflection unit thereon is improved such that the deflection unit is placed closer to the trajectories of the electron beams. In this way, the deflecting sensitivity of the deflection unit is reduced, and hence, the electron beams are deflected more widely.

Consequently, with the CRT according to the present invention, the wide-angled deflection of the electron beams can be effected, and accordingly, the power consumption can be lowered.

With this inventive structure, the CRT is reduced in thickness, and slimmed. Furthermore, the CRT with this inventive structure can be interchanged for existent CRTs, thereby decreasing the production cost and enhancing the production efficiency.

Although exemplary embodiments of the present invention have been described in detail above, it should be clearly understood that many variations and/or modifications of the basic inventive concept herein taught which can appear to those skilled in the art will still fall within the spirit and scope of the present invention, as recited in the appended claims.

What is claimed is:

1. A Cathode Ray Tube (CRT), comprising:

a panel having long and short axes and a tube axis perpendicular to the long and short axes, the panel including an inner phosphor screen;

a funnel attached to the panel, the funnel including a cone having a deflection unit arranged on an outer circumference thereof; and a neck attached to the funnel and having an electron gun arranged therein;

wherein the cone has a cross-section taken perpendicular to the tube axis with a shape transitioning from a circle to a non-circle having a maximum diameter along a direction other than the long and the short axes of the panel while proceeding from the neck to the panel, and with the cross-section of the cone centered on the tube axis, the inner and the outer surfaces of the cone in the directions of the long and the short axes of the panel bulging inward toward the tube axis;

wherein a radius of curvature Rh of an arc determining inner and the outer surfaces of the cone in a direction of the long axis of the panel satisfies the inequality: 300 mm<Rh<$^{\infty}$;

wherein a radius of curvature Rv of an arc determining inner and the outer surfaces of the cone in a direction of the short axis of the panel satisfies the inequality: 650 mm<Rv<$^{\infty}$; and wherein Rh increases while proceeding from the panel to the neck.

2. The CRT of claim 1, wherein inner and outer surfaces of the cone bulge inward at centers thereof toward the tube axis.

3. The CRT of claim 1, wherein the deflection unit comprises:

a horizontal deflection coil and a vertical deflection coil;

an insulator arranged between the horizontal deflection coil and the vertical deflection coil; and a ferrite core arranged external to the insulator, the ferrite core being attached to the vertical deflection coil;

wherein the horizontal deflection coil and the vertical deflection coil have shapes corresponding to an external shape of the cone.

4. A Cathode Ray Tube (CRT), comprising:

a panel having long and short axes and a tube axis pernendicular to the long and short axes, the panel including an inner phosphor screen;

a funnel attached to the panel, the funnel including a cone having a deflection unit arranged on an outer circumference thereof; and a neck attached to the funnel and havina an electron gun arranged therein;

wherein the cone has a cross-section taken perpendicular to the tube axis with a shape transition from a circle to a non-circle having a maximum diameter along a direction other than the long and the short axes of the panel while proceeding from the neck to the panel, and with the cross-section of the cone centered on the tube axis, the inner and the outer surfaces of the cone in the directions of the long and the short axes of the panel bulging inward toward the tube axis:

wherein a radius of curvature Rh of an arc determining inner and the outer surfaces of the cone in a direction of the long axis of the panel satisfies the inequality: 300 mm<Rh<$^{\infty}$;

wherein a radius of curvature Rv of an arc determining inner and the outer surfaces of the cone in a direction of the short axis of the panel satisfies the inequality: 650 mm<Rv<$^{\infty}$;and wherein Rv increases while proceeding from the panel to the neck.

5. The CRT of claim 4, wherein inner and outer surfaces of the cone bulge inward at centers thereof toward the tube axis.

6. The CRT of claim 4, wherein the deflection unit comprises:

a horizontal deflection coil and a vertical deflection coil;

an insulator arranged between the horizontal deflection coil and the vertical deflection coil; and a ferrite core arranged external to the insulator, the ferrite core being attached to the vertical deflection coil;

wherein the horizontal deflection coil and the vertical deflection coil have shapes corresponding to an external shape of the cone.

* * * * *